US009723914B2

(12) United States Patent
Connelly

(10) Patent No.: US 9,723,914 B2
(45) Date of Patent: Aug. 8, 2017

(54) ATTACHABLE BRUSH FOR FOOTWEAR

(71) Applicant: Dennis E. Connelly, Centennial, CO (US)

(72) Inventor: Dennis E. Connelly, Centennial, CO (US)

( * ) Notice: Subject to any disclaimer, the term of this patent is extended or adjusted under 35 U.S.C. 154(b) by 152 days.

(21) Appl. No.: 14/458,944

(22) Filed: Aug. 13, 2014

(65) Prior Publication Data

US 2016/0045021 A1 Feb. 18, 2016

(51) Int. Cl.

| | |
|---|---|
| ***A63B 57/00*** | (2015.01) |
| ***A46B 9/02*** | (2006.01) |
| ***A43B 5/00*** | (2006.01) |
| ***A46B 15/00*** | (2006.01) |
| ***A46B 5/04*** | (2006.01) |
| ***A43B 5/04*** | (2006.01) |
| ***A63B 57/60*** | (2015.01) |
| ***A43B 3/16*** | (2006.01) |

(52) U.S. Cl.

CPC ..... *A46B 15/0055* (2013.01); *A43B 3/163* (2013.01); *A43B 5/04* (2013.01); *A46B 5/04* (2013.01); *A63B 57/60* (2015.10)

(58) Field of Classification Search

CPC ..... A46B 15/0055; A46B 5/04; A43C 19/00; A63B 57/60; A63B 2200/405

USPC ..... 36/132, 136, 127; D21/795; D32/35

See application file for complete search history.

(56) References Cited

U.S. PATENT DOCUMENTS

| | | | | |
|---|---|---|---|---|
| 599,495 | A | 2/1898 | Durel et al. | |
| 776,767 | A | 12/1904 | Waters | |
| 1,292,288 | A | 1/1919 | Fisher | |
| 3,085,541 | A * | 4/1963 | Leach | B63B 59/08 114/222 |
| 3,914,882 | A * | 10/1975 | Greer | A43C 15/063 36/62 |
| 5,485,647 | A | 1/1996 | Durst | |
| 5,556,090 | A | 9/1996 | Coleman | |
| 6,393,648 | B1 | 5/2002 | Reynolds | |
| D501,725 | S | 2/2005 | Hay | |
| 7,313,842 | B1 * | 1/2008 | Preciado | A43B 3/00 15/105 |
| 8,032,969 | B1 * | 10/2011 | Connelly | A46B 15/0055 15/143.1 |
| 8,413,352 | B2 * | 4/2013 | Watkins | A43B 5/001 15/227 |
| 8,539,695 | B1 * | 9/2013 | Gemmen | A43B 3/0078 36/11.5 |
| 2006/0265826 | A1 * | 11/2006 | Kaminstein | A46B 7/04 15/176.1 |

(Continued)

*Primary Examiner* — Jila M Mohandesi

(74) *Attorney, Agent, or Firm* — Dorsey & Whitney LLP

(57) ABSTRACT

A removable brush apparatus is configured to be attached to a user's existing footwear to enable the user to effectively and easily brush away dirt or debris from a surface without the need for a separate brush or for the user to bend over to reach the surface. The brush apparatus is formed by a housing having a plurality of bristles provided on a base surface thereof and having an engagement area for interfacing with the user's footwear. The engagement area may take the form of apertures for threading shoelaces, or may have a pair of slots and a securing strap capable of adjusting the size of the housing in order to effect a secure fit to the footwear.

16 Claims, 8 Drawing Sheets

(56) References Cited

U.S. PATENT DOCUMENTS

| | | | | |
|---|---|---|---|---|
| 2006/0265828 | A1* | 11/2006 | Mallatt | A43B 3/00 15/227 |
| 2007/0240330 | A1* | 10/2007 | Beasley | A43B 3/00 36/7.2 |
| 2009/0293215 | A1 | 12/2009 | Zhou | |
| 2010/0242305 | A1* | 9/2010 | Liu | A43B 3/128 36/102 |
| 2011/0078926 | A1* | 4/2011 | Watkins | A43B 5/001 36/127 |
| 2014/0338142 | A1* | 11/2014 | Pierce | A63B 57/0087 15/246 |

* cited by examiner

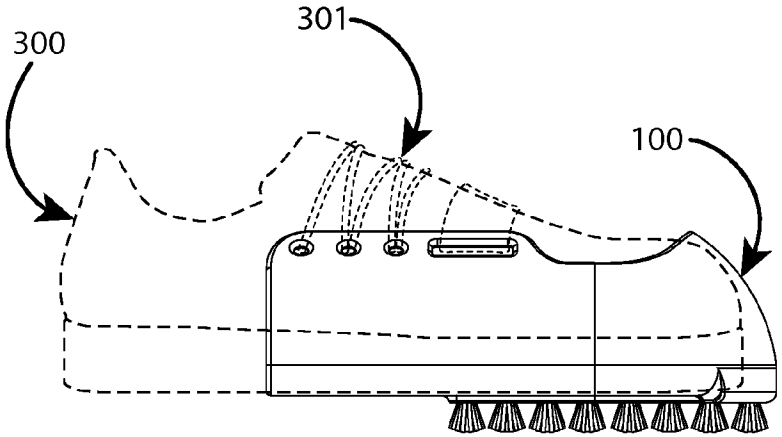
FIG. 9
FIG. 8
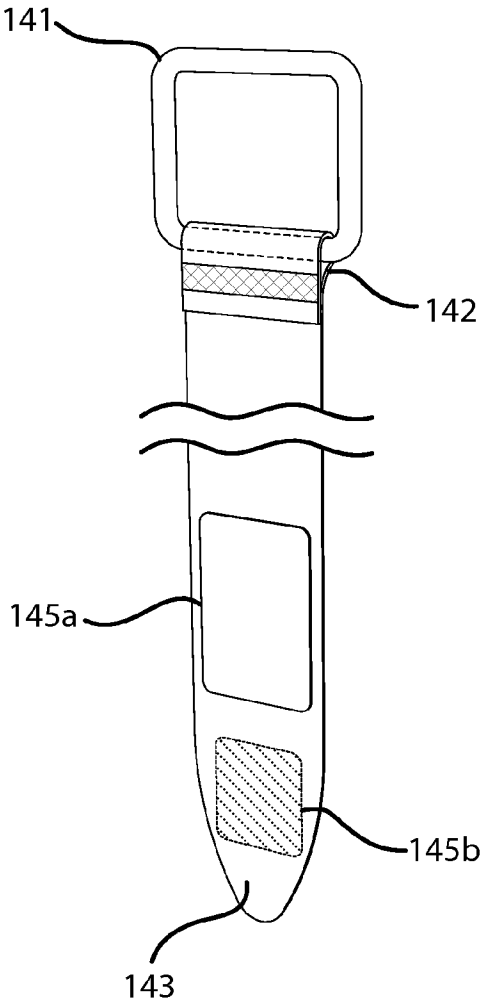

ATTACHABLE BRUSH FOR FOOTWEAR

TECHNICAL FIELD

The technology described herein relates to a brush which is attachable to a user's existing footwear and, in an exemplary embodiment, may be used by an umpire to clear dirt from home plate during a game of baseball.

BACKGROUND

In the game of baseball, it is necessary for an umpire to brush away dirt that has accumulated on home plate. This brushing action, typically done with a handheld brush, allows the batter and pitcher to clearly see where home plate is and therefore where the strike zone is. Conventionally, this action requires the use of a hand-held brush which requires the umpire to bend over to wipe away the dirt, which not only takes time but subjects the umpire to possible back stress and strain. Consequently, the umpire may not brush the plate as often as needed, thus compromising the strategies of the game for both teams. Accordingly, there exists a need for a device by which the brushing off of home plate can be accomplished in a manner which does not require the umpire to bend over.

The information included in this Background section of the specification, including any references cited herein and any description or discussion thereof, is included for technical reference purposes only and is not to be regarded subject matter by which the scope of the invention as defined in the claims is to be bound.

SUMMARY

The technology disclosed herein was developed in light of the deficiencies in the prior art as discussed above.

In particular, the present disclosure is related to a removable brush housing capable of attaching to a user's existing footwear. The brush housing is designed to be universal in design in order to accommodate many different sizes or styles of shoes. A strap may be provided on the housing which enables removable attachment to the footwear. Alternatively or in addition to the strap, existing laces or other conventional footwear closure mechanisms may be threaded or interlocked with the brush housing, thereby also attaching the housing to the footwear. The brush apparatus of one embodiment is designed so that a simple, natural motion by the umpire can effectively clear the dirt and other debris from home plate while the umpire is standing.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present invention as defined in the claims is provided in the following written description of various embodiments of the invention and illustrated in the accompanying drawings.

BRIEF DESCRIPTION OF THE DRAWINGS

FIG. 8 is an isometric view of an exemplary securing strap for use with the brush apparatus.

FIG. 9 is a right side elevation view of a user's footwear engaging the brush apparatus.

DETAILED DESCRIPTION

As discussed above, the present disclosure is generally related to removable brush device configured to be attached to a user's existing footwear. Though in an exemplary embodiment the brush device may be described in the context of a baseball umpire clearing debris from home plate, the brush device is not limited to this use and could serve other purposes equally well. For instance, the brush apparatus could be used for clearing dirt and debris from any other suitable surface, such as a floor of a user's home or workplace. Alternatively, the brush apparatus can be utilized in combination with another process such as buffing or polishing a floor.

Additionally, the unique design of the housing enables an adjustable fit which is capable of attaching to a user's footwear regardless of whether the footwear has compatible laces or other securing structures. The brush apparatus is designed to fit a large range of sizes and designs of footwear, including those having cleats or other additions which increase the overall size of the footwear.

Figure 1:
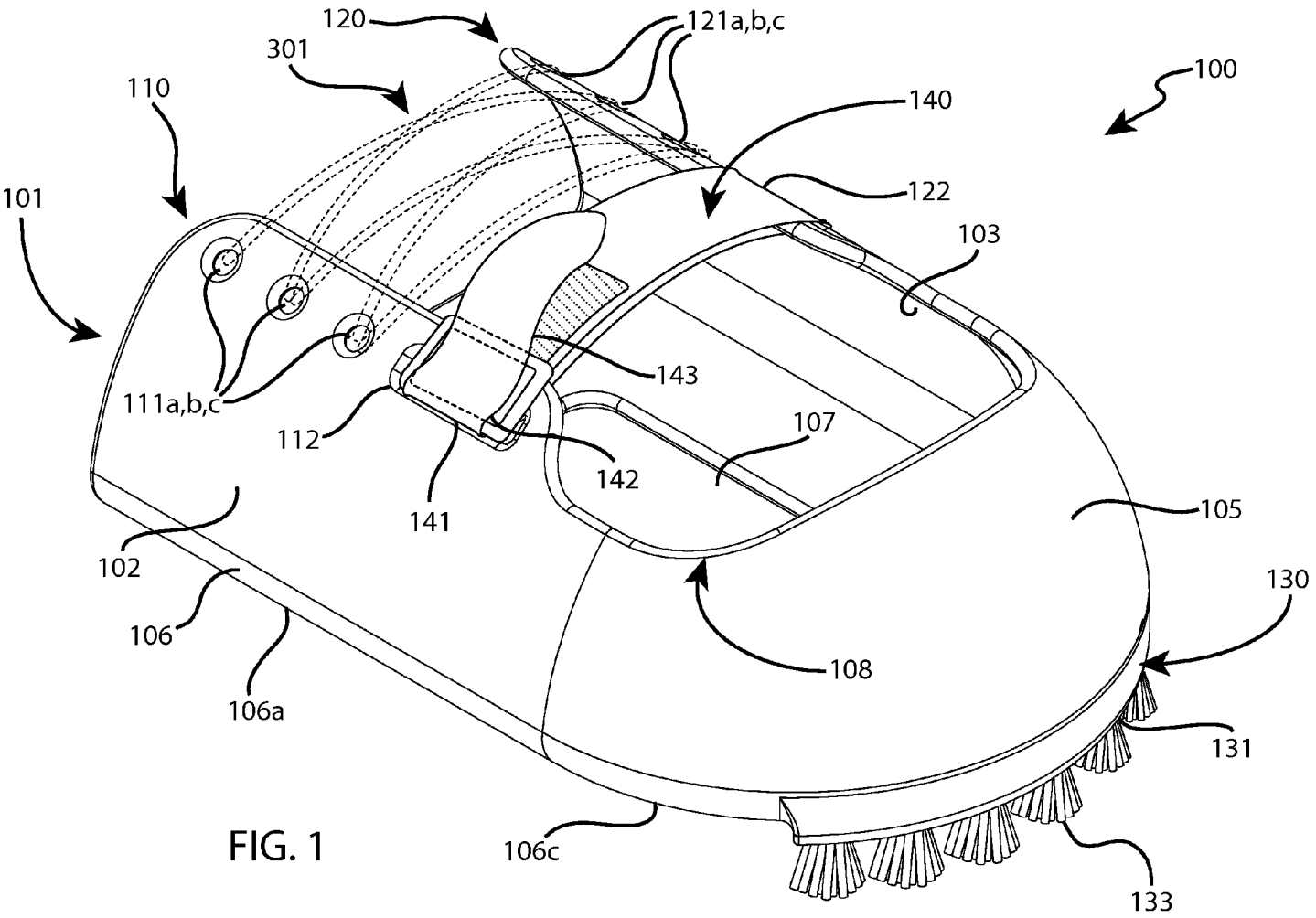
FIG. 1 is an isometric view an exemplary embodiment of a brush apparatus.

As depicted in FIG. 1, according to an exemplary embodiment the brush apparatus 100 is formed by a housing 101 having a generally planar base 106, a right wall 102, a left wall 103, and a front wall 105. The right, left, and front walls 102,103,105 extend in a first upward direction away from the base 106 and are generally curved toward one another. In many embodiments, the right, left, and front walls 102, 103,105 and the base 106 may be connected and monolithically formed as a single piece. As shown best in FIGS. 1 and 3, the walls 102,103,104 are formed such that their upper edges form a channel 109 (see FIG. 3). A footwear compartment 104 is defined by a cavity within the housing 101 for receiving a user's footwear 300, particularly a toe portion of the footwear 300. (See for example FIG. 9 where footwear 300 is engaged with the housing 101.) The right, left, and front walls 102,103,105 and the base 106 collectively form the housing 101. It should be noted that the front wall 105 is not necessary for the overall function of the brush apparatus 100 and may be omitted if desired, wherein the housing 101 is instead constituted by the base, 106, the left wall 102, and the right wall 103.

The housing 101 itself may be formed out of any suitable material such as plastics, resins, rubber, or other flexible and resilient light-weight material. In many embodiments the housing is made of a molded plastic such as high-density polyethylene (HDPE), polyvinyl chloride (PVC), polycarbonate, polyurethane closed-cell resin, or other plastics, elastomers, or resins which can withstand the normal wear and tear while being worn on a user's foot. The housing may be formed by any suitable manufacturing process such as injection molding, thermoforming, extrusion, blow molding, stamping, casting, or 3D printing.

The generally planar base 106 is sized and shaped to be generally larger than the average sized footwear 300. This ensures that the housing 101 is compatible with the wide variety of shoes by virtue of the adjustable securing structures discussed below in more detail. However, the housing 101 may be made in a variety of sizes to better fit over different footwear sizes or specific ranges of footwear sizes. An aperture 107 may optionally be provided in the base 106 in order to provide an easier user experience when attaching the footwear 300. The sole of the footwear 300 may thereby be exposed to less friction and interference from the base 106 when the footwear 300 is inserted into the footwear compartment 104. Further, the aperture 107 reduces the overall weight of the housing 101 without reducing overall structural integrity.

Figure 3:
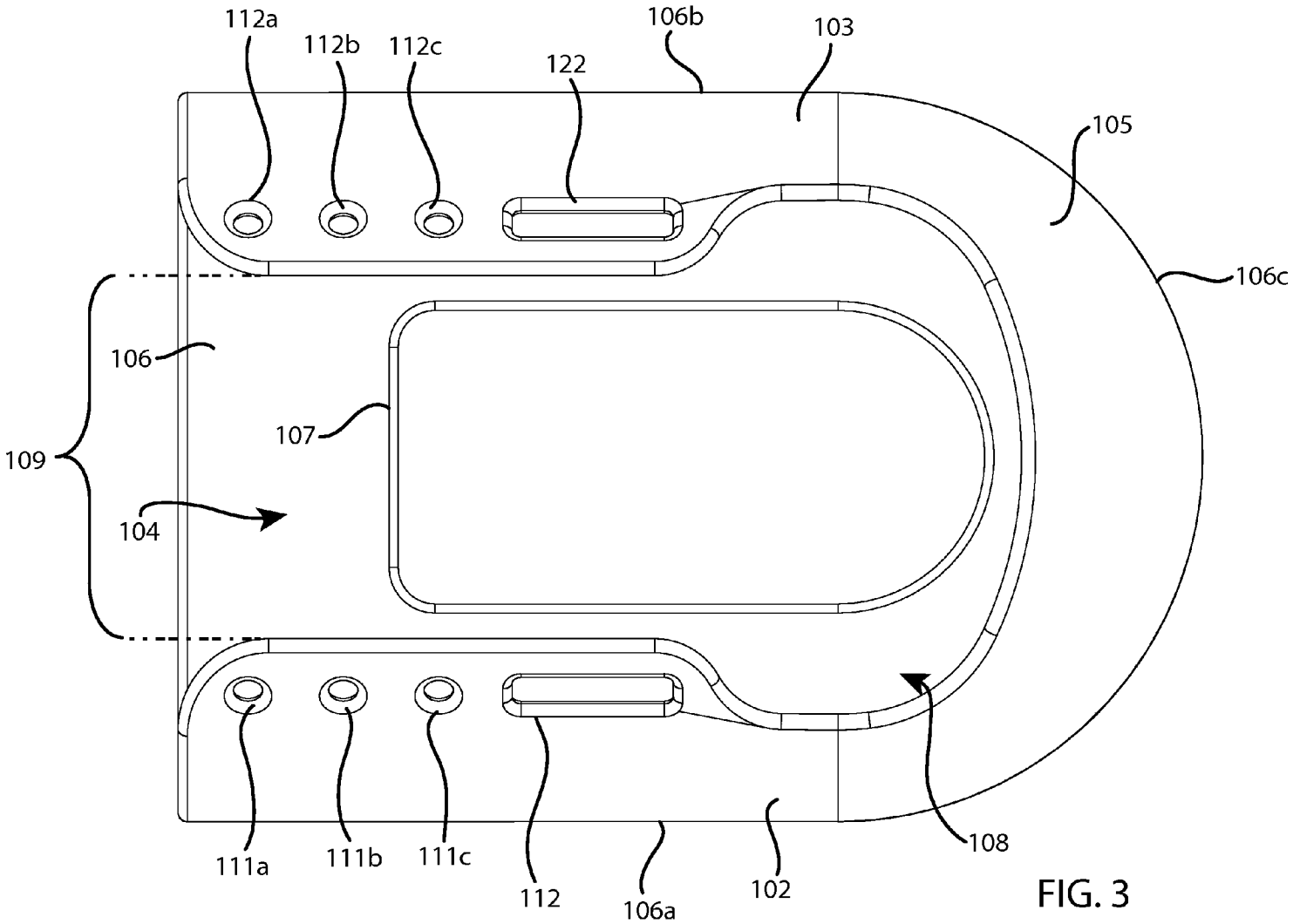
FIG. 3 is a top plan view of the brush apparatus of FIG. 1.

As mentioned above, the right, left, and front walls 102,103,105 are curved such that in their they form channel 109 with the upper edges thereof (see for example FIG. 3). The channel 109 is sufficiently large to accommodate a variety of styles and designs of footwear, including footwear having cleats, orthopedic soles, or other features which increase the height of the footwear. Accordingly, the size of the channel 109 and dimensions of the base 106 are variable. The housing 101 may be sized to accommodate a generally smaller user, such as a younger little league player, or a full-sized adult. In one embodiment, the housing is sized to accommodate a wide range of sizes of user footwear by use of a securing strap 140 or apertures 111,121 as discussed in more detail below. An optional upper housing opening 108, defined at one end of the channel 109 by the walls 102,103, 105 and generally wider than the channel 109, is provided in order to enable the user's foot to breathe while also enabling the user to easily and securely insert the footwear 300 into the housing 101. The wider housing opening 108 may also allow for greater flexibility of movement in the side walls 102, 103.

Figure 2:
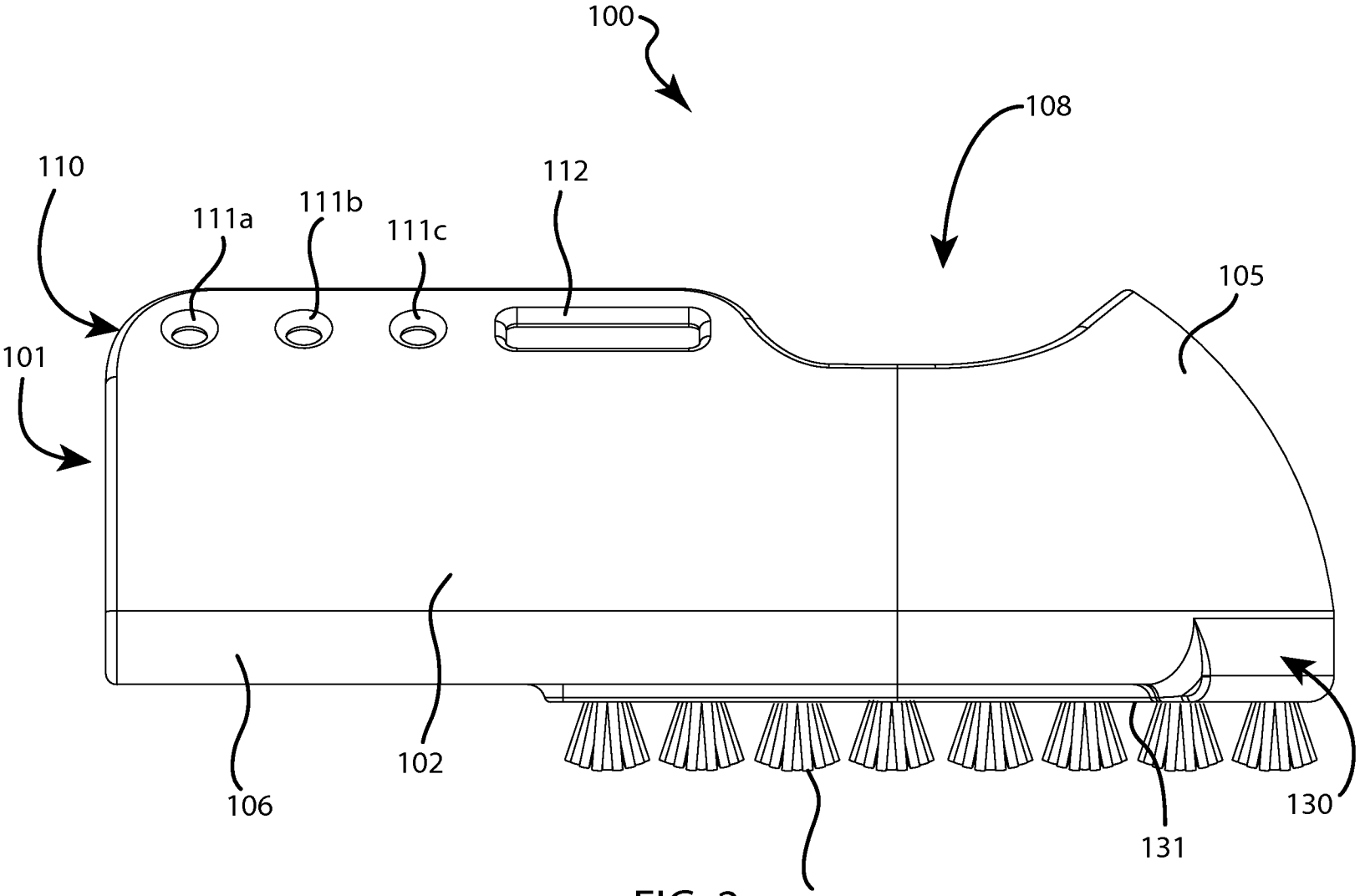
FIG. 2 is right side elevation view of the brush apparatus of FIG. 1.
Figure 5:
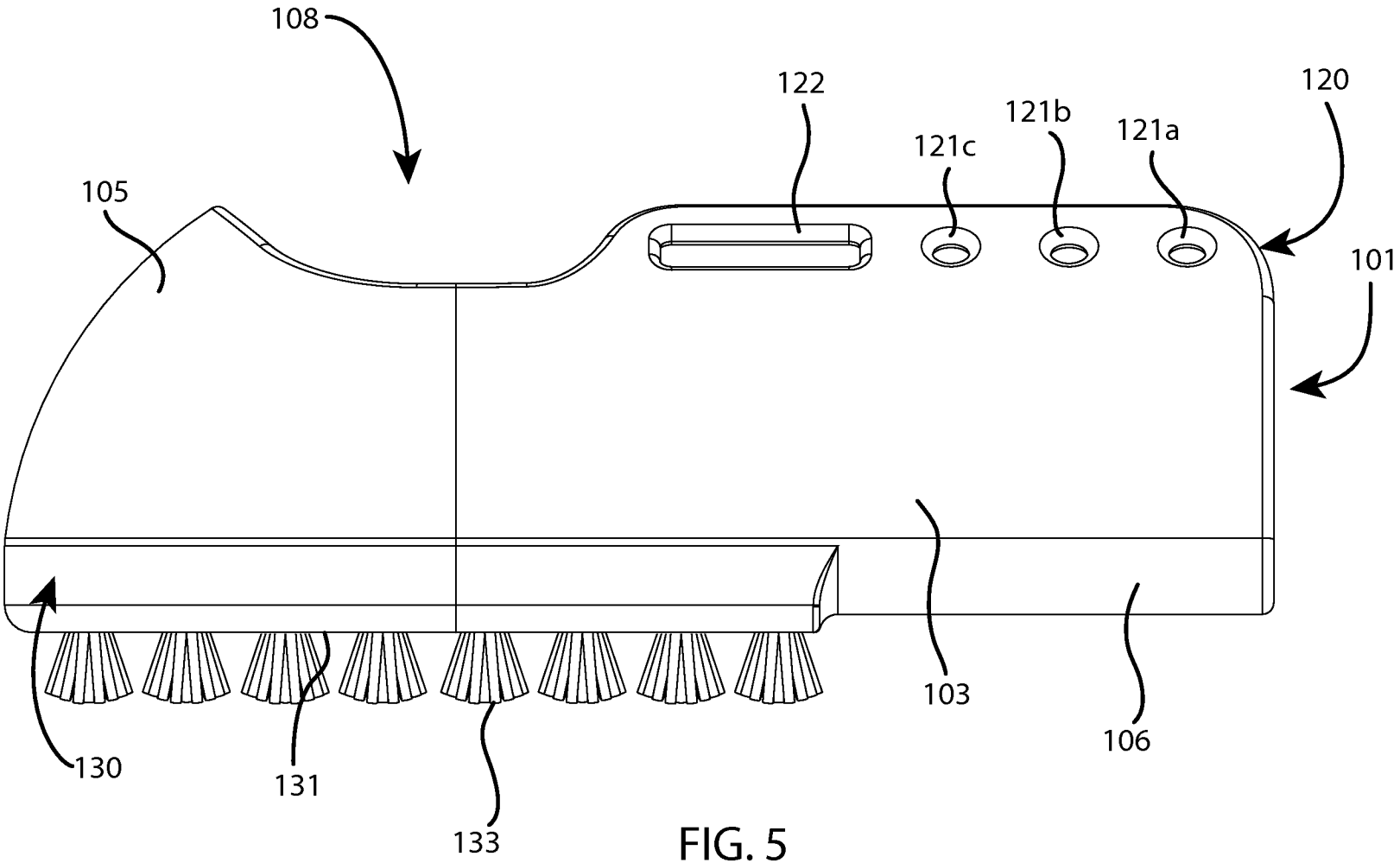
FIG. 5 is left side elevation view of the brush apparatus of FIG. 1.
Figure 6:
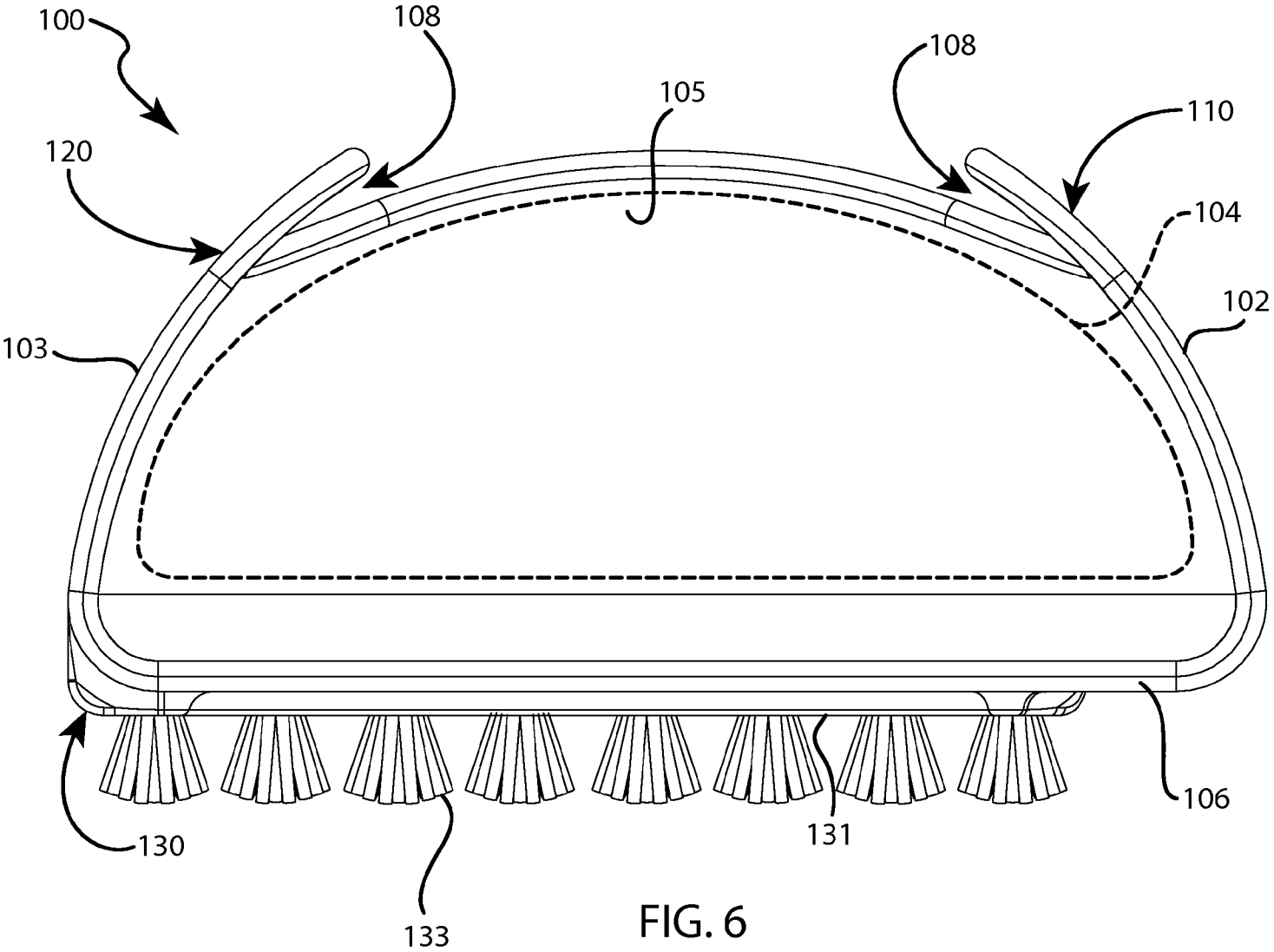
FIG. 6 is a rear elevation view of the brush apparatus of FIG. 1.

With reference to FIGS. 1, 2, and 5, the housing 101 is also provided with a right wall engagement section 110 and left wall engagement section 120. In the exemplary embodiment shown, the engagement sections 110,120 are generally similar and symmetrical in their design and position; however, they need not be so. The engagement sections may have symmetric or non-symmetric securing features which cooperate to selectively secure the housing 101 about or to the footwear 300. In some embodiments, the engagement sections 110, 120 may also aid in adjusting the size of the channel 109, which enables a better and more secure fit as discussed in more detail below.

In an exemplary embodiment, the engagement sections 110,120 of the right and left wall, respectively, may define a set of apertures 111*a,b,c* and 121 *a,b,c* a securing features through which the securing means of the footwear 300, such as shoelaces 301, can be threaded and interlocked with the plurality of apertures 111 and 121. As shown in FIG. 1, the engagement sections 110,120 may have a set of three apertures 111,121, but greater or fewer apertures could be provided in order to meet specific needs. Alternatively, a shoelace separate from a shoelace 301 of the footwear may be threaded through the apertures 111*a,b,c* and 121*a,b,c* to aid in securing the housing 101 to the footwear 300.

In addition to or instead of the right and left apertures 111,121, the housing 101 may further be provided with a right slot 112 and left slot 122. The slots 112,122 can be of any suitable shape such that an adjustable securing mechanism can be threaded therethrough. In an exemplary embodiment, the securing mechanism may be a securing strap 140 which is threaded through opposing slots 112,122 such that the strap 140 extends across the channel 109 formed by the housing 101. The strap 140 can be of any design which enables the housing 101 to be removably secured to the footwear 300. In a one embodiment, the strap 140 can operate to adjust the size of the channel 109, for example, by pulling the engagement sections 110, 120 of the sidewalls 102, 103 closer together such that a user with a smaller foot or smaller overall footwear 300 can reliably attach the housing 101 to the footwear. Alternatively, in situations where larger footwear 300 pushes the engagement sections 110, 120 farther apart than the standard width of the channel 109, the strap 140 may be long enough to allow for such expansion while still securing the engagement sections 110, 120 to each other and the housing 101 about the footwear 300. In other instances, the size of the channel 109 may not be adjusted and instead physical contact between the strap 140 and the footwear 300 may function to reliably retain the housing on the footwear.

Figure 7:
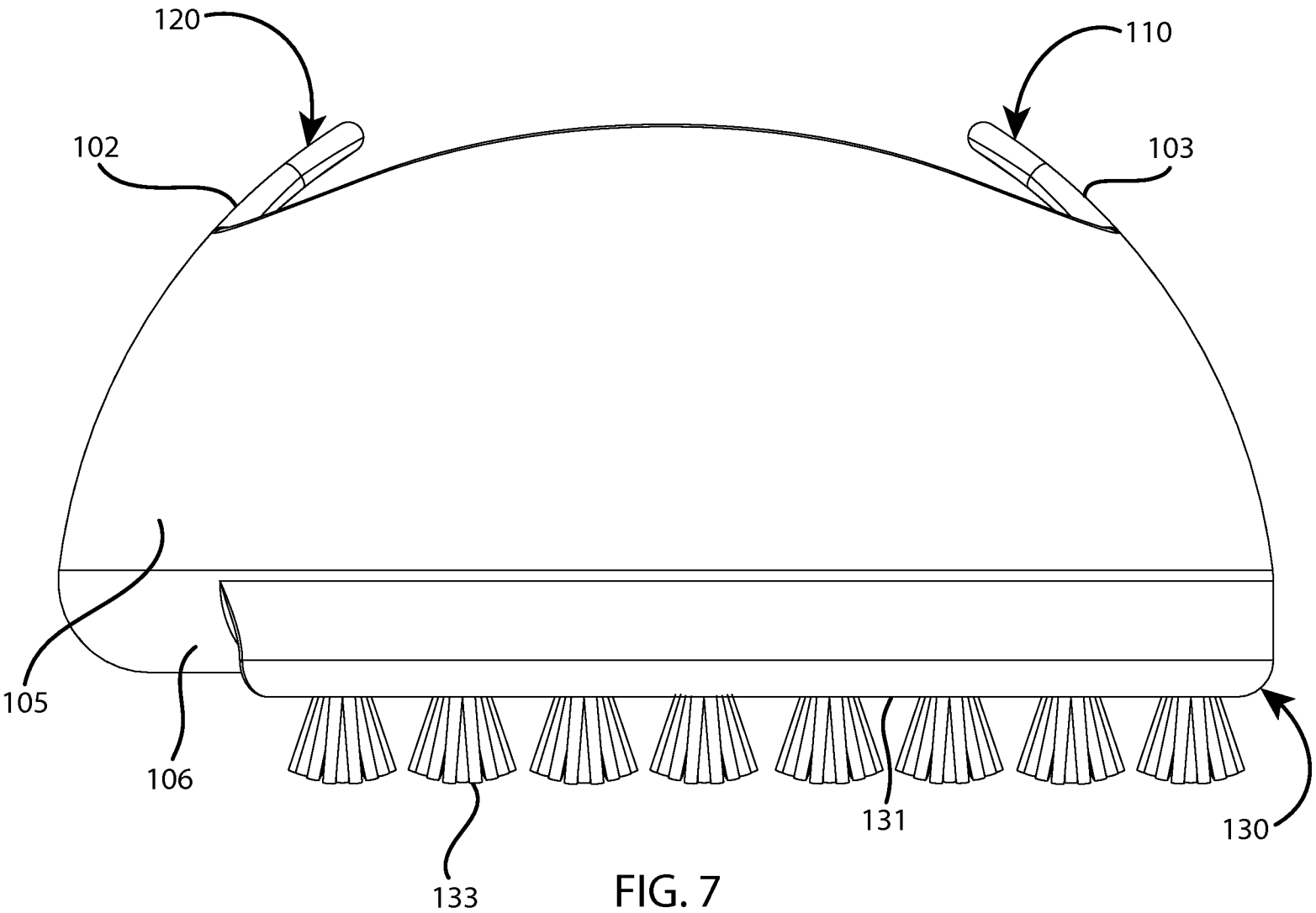
FIG. 7 is a front elevation view of the brush apparatus of FIG. 1.

In an exemplary embodiment, and with reference to FIGS. 1 and 7, the channel 109 can be made adjustable by using the securing strap 140 which is sufficiently elongated to span the channel 109 at least once. In other embodiments the securing strap 140 may further be of sufficient length to span the channel 109 at least twice. As shown in FIG. 7, in an exemplary embodiment the strap 140 is provided with a first strap securing section 145*a* between a first end 142 and a second end 143, which enables a second strap securing section 145*b* adjacent the second end 143 of the strap 140 to be secured the first strap securing section 145*a* at an intermediate section of the strap between the first end 142 and second end 143 thereof. The strap securing sections 145*a,b* may be of any suitable type to removably and adjustably secure the strap, and thereby may operate as an adjustment mechanism. In some embodiments, the securing sections 145*a,b* have a hook-and-loop fastener patches disposed thereon. In other embodiments, one or more snaps, buttons, a ratcheting mechanism, or other suitable means of adjusting effective strap length may be provided. The strap securing sections 145*a,b* enable adjustment of the overall length of the strap 140 such that, when the strap 140 is threaded through slots 112,122 in the engagement sections 110, 120 of the housing 101 as depicted in FIG. 1 and secured, the housing 101 can be secured to the footwear 300 either by frictional or interference contact with the footwear 300. Alternatively, the strap 140 may function to appropriately adjust the size of the channel 109 to securely attach the housing 101 to the footwear 300.

Referring again to FIG. 7, the strap 140 according to an exemplary embodiment may further be provided with a retaining means 141 at its first end. The retaining means 141 can take on a variety of shapes such that the strap 140 cannot fully pass through one of the slots 112,122, such as a square-ring, D-ring, circular ring, linear bar, or buckle. In an exemplary embodiment, the retaining means 141 may be a square-ring sized and shaped so that it cannot pass through the slot 112 when the strap 140 is threaded therethrough. Once threaded through, for example, slot 112 of the right wall 102, the strap 140 may extend over the channel 109 and thread through the slot 122 of the left wall 103. Once threaded through both slots 112,122, the second end 143 of the strap 140 may then be secured to itself using the first and second strap securing sections 145*a,b*. If provided with sufficient length, the strap 140 may be threaded through the slot 112 again before being secured to itself, or alternatively the second end 143 of the strap may be threaded through the retaining means 141 before being secured by the securing section 145. The first securing section 145*a* may enable securing in multiple locations (e.g., by extending along a majority of the length of the strap 140) such that the effective length of the strap 140 can be adjusted to thereby adjust the size of the channel 109, or such that the strap 140 is in contact with the footwear 300 in order to secure the housing 101 to the footwear. It should be noted that the housing 101 may be secured to the footwear 300 using the laces 301 threaded through the apertures 111,121, the strap 140 threaded through slots 112,122, or a combination of both. Additionally, though discussed above as a separate member, the strap 140 may be integrally attached to the housing 101, such as by wrapping a first end 142 through one of the slots 112,122 and securing it to the strap by conventional means such as stitching or adhesive. Accordingly, a separate retaining means would not be needed.

Figure 4:
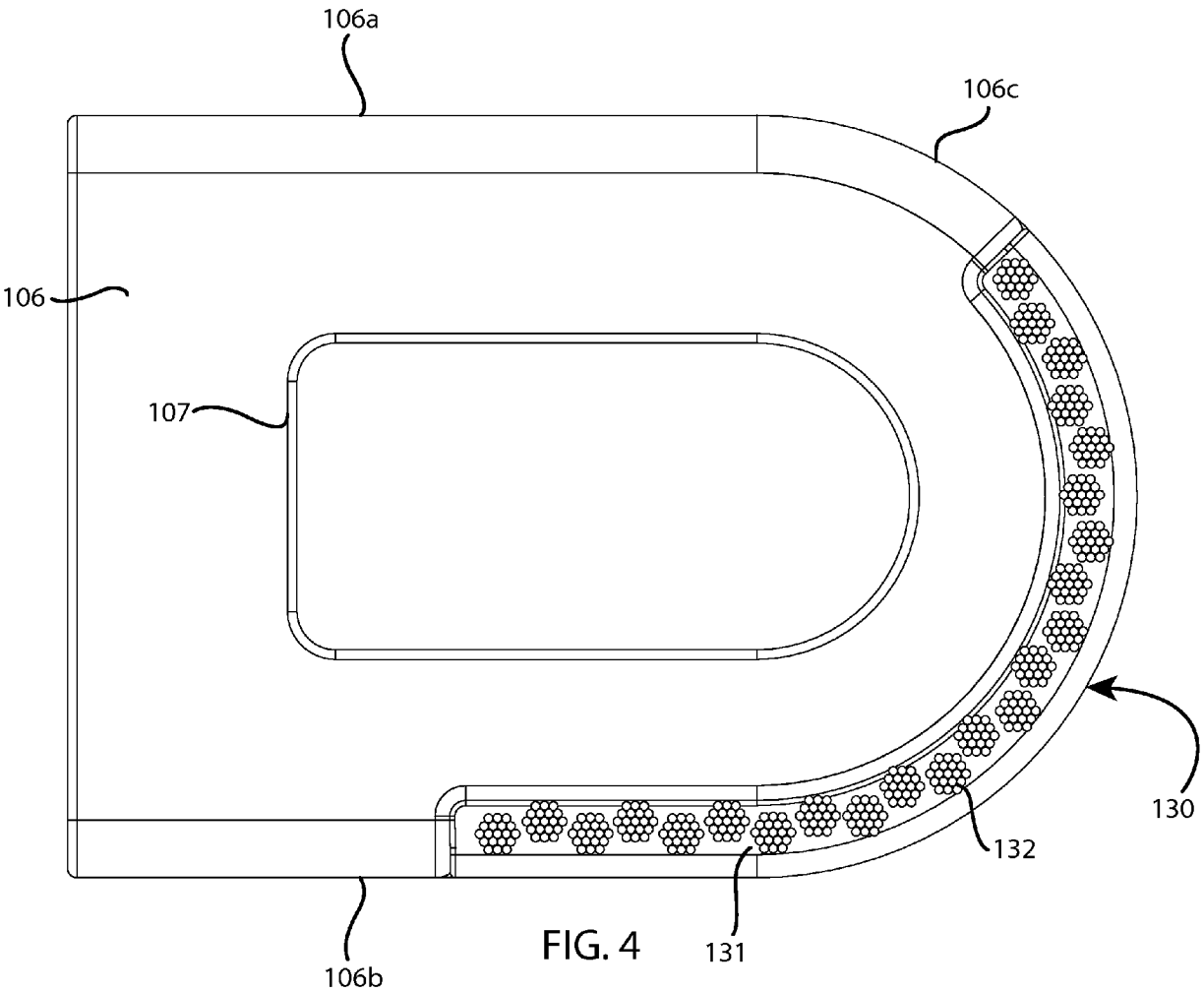
FIG. 4 is a bottom plan view of the brush apparatus of FIG. 1.

Referring now to FIGS. 2 and 4, but depicted in other figures, the base 106 is provided with a brush portion 130 disposed around a perimeter edge thereof. The brush portion 130 has a brush platform 131 containing bristle apertures 132 for receiving a plurality of bristles 133 therein. As shown in FIG. 4, in an exemplary embodiment the brush platform 131 may extend along a portion of the second linear edge 106*b* and the curved edge 106*c* below the bottom surface of the base 106. However, it is not limited to this and could extend along all or portions of each of the first linear edge 106*a*, second linear edge 106*b*, and curved edge 106*c*, or on only one of the linear edges. Further, while depicted as continuous, the brush platform 131 may be discontinuous such as being provided on a first linear edge 106*a* and second linear edge 106*b* but not on the curved edge 106*c*. A plurality of bristle apertures 132 are provided in the brush platform 131. Though bristle apertures 132 are depicted as discontinuous and staggered, the bristle apertures 132 are not limited to this and may be disposed in a continuous, discontinuous, linear, or non-linear manner according to bristle material chosen and/or intended use. The brush portion 130 may be formed of the same material as the housing 101, or may be formed of a different material. For example, the housing 101 may be formed from a more rigid high-density polyethylene, while the brush portion 130 may be formed of low-density polyethylene in order to provide a certain amount of flex to increase brushing efficiency.

The bristles 133 may be made of any suitable material, either natural or man-made, for example, horse hair, straw, nylon, PVC, etc., and are generally chosen to be semi-rigid in order to impart sufficient force to clear dirt and debris from home plate, the ground, or a floor surface. Bristle design and material may be chosen not be too rigid to impede a normal and comfortable stance, or overly flexible such that bristle resiliency is reduced. The ordinary artisan would readily be able to choose from among different bristle designs and materials to effect this balance, or choose to have more resiliency at the cost of bristle coarseness. The bristles 133 may be attached to the housing within the bristle apertures 132 by adhesive, friction fit, stitching, ultrasonic welding, or any other appropriate method of attachment, or a combination thereof. Additionally, instead of having plural bristle members, the bristle portion 133 may be constituted by a blade-like bristle (not shown) such as those conventionally used with windshield wipers or squeegee apparatuses. Furthermore, the length of the bristles may be chosen to suit the particular need of the user. Typically, the bristles 133 may have a length greater than one-quarter inch and less than an inch, but other lengths may be desirable for specific applications.

As discussed above, the brush apparatus 100 can have a multitude of uses. In an exemplary embodiment, in the context of the game of baseball, an umpire may place their footwear 300 into the footwear compartment 104 of the brush apparatus 100 defined by the housing 101 (see FIG. 8). The user may then proceed to secure the housing 101 to his or her footwear 300 by means of the strap 140, separate laces threaded through apertures 111,112, or by threading existing footwear closure members such as laces 301 through the corresponding engagement sections 110,120 on the housing. Once threaded through apertures 111,112, the laces 301 are tightened in a conventional way and tied to thereby secure the housing to the footwear 300. In other embodiments, the securing features in the engagement sections 110, 120 may be configures for attachment to a strap, hook and loop fastener pairs, an elastic material, or other types of closure members on footwear. When the strap 140 is used, it may be provided already threaded through the slots 112,122 or the user may perform this step. Once the footwear 300 is inserted in the footwear compartment 104, the user can then adjust the length of strap 140 by adjusting where the second securing section 145*b* of the second end 143 is attached to the first securing section 145*a*. In this way, the securing strap 140 may be adjustable such that the housing 101, in particular the housing 101, can conform to the shape of the user's footwear 300 to thereby secure the housing 101 thereto. As discussed above, alternatively the strap 140 may be used to directly contact the footwear 300 in a frictional or interfering relationship such that the housing 10 is secured to the footwear.

Once attached to the footwear 300, the user may resume a normal, comfortable stance and when necessary may simply adjust their position and use a single foot to clear away dirt and debris. In the exemplary embodiment for use by a baseball umpire, this action will typically be repeated several times throughout a particular game of baseball to clear dirt from home plate. Since this operation can be done without repeatedly bending over or without having to reach for and store a separate brushing device, the user is likely to perform this task more often. Therefore, the umpire and other players can more easily determine the strike zone, thereby improving gameplay and performance. In other uses, by not requiring a user to repeatedly bend over or assume a crouched position to clear dirt or debris, the brush apparatus discussed above can reduce back strain while effectively clearing debris.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present invention, and do not create limitations, particularly as to the position, orientation, or use of the invention. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order and relative sizes reflected in the drawings attached hereto may vary.

The above specification, examples and data provide a complete description of the structure and use of exemplary embodiments of the invention as defined in the claims. Although various embodiments of the claimed invention have been described above with a certain degree of particularity, or with reference to one or more individual embodiments, those skilled in the art could make numerous alterations to the disclosed embodiments without departing from the spirit or scope of the claimed invention. Other embodiments are therefore contemplated. It is intended that all matter contained in the above description and shown in the accompanying drawings shall be interpreted as illustrative only of particular embodiments and not limiting. Changes in detail or structure may be made without departing from the basic elements of the invention as defined in the following claims.

What is claimed is:

1. An overshoe for attachment to a plurality of sizes of footwear comprising a housing made of a molded plastic material comprising a substantially flat base and curved walls extending upward from the base including a front wall curved backward extending over a toe portion of the footwear, a medial wall curved laterally over a medial instep portion of the footwear and a lateral wall curved medially over a lateral instep portion of the footwear, wherein the housing is sized to extend only about a front portion of the footwear from the toe portion to along the instep portion of the footwear;

the curved walls define a channel formed between the lateral and medial walls above the base positioned above a top of the footwear from the toe portion of the footwear to along the instep portion of the footwear;

the base and the curved walls form a compartment for receiving and covering the toe portion of the footwear; and the base defines an opening therein surrounded by the base and positioned to extend from under the toe portion to under the instep portion of the footwear such that a portion of a sole of the footwear can extend therethrough to contact a surface;

an engagement section formed in the lateral and medial walls adjacent to the channel, the engagement section having one or more securing features provided adjacent to the channel configured for securing the housing to the footwear across the channel over the top of the footwear from the toe portion and over the instep portion when the footwear is positioned in the compartment of the housing; and a brush portion comprising a plurality of bristles provided on and extending downward from the housing, wherein the plurality of bristles is positioned to extend downward beyond the base only along a front edge and a medial edge of the housing.

2. The overshoe according to claim 1 further comprising a securing strap attached to and cooperating with one or more of the securing features; wherein the securing strap is configured to extend across the channel over the top of the instep portion of the footwear; and the securing strap reversibly secures the housing to the footwear.

3. The overshoe according to claim 1, wherein opposing areas of the curved walls are contoured toward each other to form the engagement section and define the channel.

4. The brush apparatus according to claim 1, wherein the channel is configured to allow the lateral and medial walls defining the compartment to expand outward or contract inward to receive the portion of the footwear.

5. The overshoe according to claim 1, wherein the base further comprises a linear medial edge, a linear lateral edge substantially parallel to and spaced apart from the linear medial edge, and a curved edge extending between an end of the linear medial edge and an end of the linear lateral edge and positioned around the toe portion of the footwear, which together define the perimeter of the base; and the brush portion further comprises a brush platform extending below the base and the plurality of bristles are disposed on the brush platform to extend substantially normal to a bottom surface of the base.

6. The overshoe according to claim 5, wherein the brush platform is disposed along a portion of the curved edge and a portion of the linear medial edge.

7. The overshoe according to claim 2, wherein the securing strap further comprises a first end, a second end distal to the first end, and an adjustment mechanism;

the securing features further comprise a first slot on a first side of the engagement section and second slot on a second side of the engagement section;

wherein the securing strap is threaded through the first slot and second slot, and the adjustment mechanism is operable to reversibly adjust a separation distance between portions of the engagement section on opposing sides of the channel across the instep portion of the footwear.

8. The overshoe according to claim 7, wherein the securing strap further comprises a retaining structure at the first end sized to prevent passage of the retaining structure through either or both of the first slot or the second slot.

9. The overshoe according to claim 1, wherein the securing features further comprise a plurality of apertures defined within the engagement section on opposing sides of the channel.

10. The overshoe according to claim 9, wherein the plurality of apertures are configured to engage a securing mechanism of the footwear in order to secure the housing to the footwear.

11. The overshoe according to claim 10, wherein plurality of apertures are configured to engage the securing mechanism of the footwear when the securing mechanism is a set of shoelaces.

12. An overshoe for attachment to a plurality of sizes of footwear having one or more closure members, the apparatus comprising a housing comprising a substantially flat base and curved walls extending upward from the base including a front wall curved backward extending over a toe portion of the footwear, a medial wall curved laterally over a medial instep portion of the footwear and a lateral wall curved medially over a lateral instep portion of the footwear, wherein the housing is sized to extend only about a front portion of the footwear from the toe portion to along the instep portion of the footwear;

the curved walls define a channel between two opposing edges of the lateral and medial walls positioned above and opposite the base above a top of the footwear from the toe portion of the footwear to along the instep portion of the footwear; and the base defines an opening therein surrounded by the base and positioned to extend from under the toe portion to under the instep portion of the footwear such that a portion of a sole of the footwear can extend therethrough to contact a surface;

an engagement section having a plurality of securing features provided on the opposing edges of the lateral and medial walls adjacent to the channel configured to engage closure members of the footwear to secure the housing to the footwear over the instep portion when the footwear is positioned within the housing; and a brush portion comprising a plurality of bristles provided on the housing, wherein the plurality of bristles is positioned to extend downward beyond the base only along a front edge and a medial edge of the housing.

13. The overshoe according to claim 12, wherein the footwear closure member further comprises at least one of the group consisting of a shoelace, strap, hook and loop fastener pairs, and an elastic material; and wherein the engagement section of the overshoe is configured to couple to the footwear closure member to reversibly secure the overshoe to the footwear.

14. The overshoe according to claim 13, wherein at least one of the plurality of securing members is configured to interlock with the closure member of the footwear.

15. The overshoe according to claim 12 further comprising a securing strap having a first end, a second end distal to the first end, and an adjustment mechanism; wherein the securing features further comprise a first slot on the lateral wall of the engagement section and second slot on the medial wall on opposing sides of the channel; and the securing strap is threaded through the first slot and second slot, and the adjustment mechanism is operable to reversibly adjust a separation distance between the opposing edges of the lateral and medial walls across the instep portion of the footwear.

16. The overshoe according to claim 12, wherein the base further comprises a linear medial edge, a linear lateral edge substantially parallel to and spaced apart from the linear medial edge, and a curved edge extending between an end of the linear medial edge and an end of the linear lateral edge around the toe portion of the footwear; and the brush portion further comprises a brush platform extending below the base and the plurality of bristles are disposed on the brush platform to extend substantially normal to a bottom surface of the base.

* * * * *